US007588425B2

(12) United States Patent
Chung

(10) Patent No.: US 7,588,425 B2
(45) Date of Patent: Sep. 15, 2009

(54) REVERSIBLE INFLATION SYSTEM

(75) Inventor: Tsai Chun Chung, Tanshui (TW)

(73) Assignee: Aero Products International, Inc., Wauconda, IL (US)

( * ) Notice: Subject to any disclaimer, the term of this patent is extended or adjusted under 35 U.S.C. 154(b) by 479 days.

(21) Appl. No.: 11/084,219

(22) Filed: Mar. 18, 2005

(65) Prior Publication Data

US 2006/0210413 A1 Sep. 21, 2006

(51) Int. Cl.
*F04B 19/00* (2006.01)
*A47C 27/08* (2006.01)

(52) U.S. Cl. ..... 417/315; 5/713

(58) Field of Classification Search ..... 417/315; 5/713, 715

See application file for complete search history.

(56) References Cited

U.S. PATENT DOCUMENTS

| | | | | |
|---|---|---|---|---|
| 1,451,136 | A | 4/1923 | Allnut | |
| 3,068,494 | A | 12/1962 | Pinwater | |
| 3,099,386 | A | 7/1963 | Pieper | |
| 3,142,850 | A | 8/1964 | De Boer | |
| 3,505,695 | A | 4/1970 | Bishaf et al. | |
| 3,563,676 | A | 2/1971 | Coover et al. | |
| 4,080,105 | A | 3/1978 | Connell | |
| 4,087,871 | A * | 5/1978 | Benthin | 4/217 |
| 4,146,069 | A | 3/1979 | Angarola et al. | |
| 4,146,070 | A | 3/1979 | Angarola et al. | |
| 4,213,745 | A | 7/1980 | Roberts | |
| 4,225,989 | A | 10/1980 | Corbett et al. | |
| 4,435,864 | A | 3/1984 | Callaway | |
| 4,521,166 | A | 6/1985 | Phillips | |
| 4,594,743 | A | 6/1986 | Owen et al. | |
| 4,644,597 | A | 2/1987 | Walker | |
| 4,678,014 | A | 7/1987 | Owen et al. | |
| 4,692,091 | A | 9/1987 | Ritenour | |
| 4,734,017 | A | 3/1988 | Levin | |
| 4,829,616 | A | 5/1989 | Walker | |
| 4,862,533 | A | 9/1989 | Adams | |
| 4,890,344 | A | 1/1990 | Walker | |
| 4,896,389 | A | 1/1990 | Chamberland | |
| 4,897,890 | A | 2/1990 | Walker | |
| 4,977,633 | A | 12/1990 | Chaffee | |

(Continued)

FOREIGN PATENT DOCUMENTS

| | | |
|---|---|---|
| WO | WO 93/05684 | 4/1993 |

(Continued)

OTHER PUBLICATIONS

International Search Report from Corresponding International Application No. PCT/US2006/009566, dated Jun. 21, 2006, 13 pages.

*Primary Examiner*—Charles G Freay
(74) *Attorney, Agent, or Firm*—Brinks Hofer Gilson & Lione

(57) ABSTRACT

A reversible inflation system allowing a single pump to be used for both inflation and deflation of the air bladder. The present embodiment of the inflation system includes a motor and an impeller located within a housing having a diaphragm valve and a slide. Presently, the slide determines the direction of fluid flow through the housing, so that in a first position, the system causes fluid to flow into the bladder, and in a second position, the system causes fluid to flow out of the bladder.

11 Claims, 7 Drawing Sheets

U.S. PATENT DOCUMENTS 4,982,466 A 1/1991 Higgins et al.
5,051,060 A 9/1991 Fleischmann et al.
5,052,894 A 10/1991 Rimington
5,068,933 A 12/1991 Sexton
5,079,785 A 1/1992 Garcia
5,170,522 A 12/1992 Walker
5,267,363 A 12/1993 Chaffee
5,367,726 A 11/1994 Chaffee
5,406,661 A 4/1995 Pekar
5,452,487 A 9/1995 Leggett
5,493,742 A 2/1996 Klearman
5,494,418 A 2/1996 Moriya et al.
5,746,873 A 5/1998 Graf
5,857,841 A 1/1999 Kobayashi et al.
5,890,882 A 4/1999 Feldman
5,893,609 A 4/1999 Schmidt
5,903,941 A 5/1999 Shafer et al.
5,938,410 A * 8/1999 Lee ..... 417/234
5,941,272 A 8/1999 Feldman
5,963,997 A 10/1999 Hagopian
6,073,291 A 6/2000 Davis
6,099,248 A 8/2000 Mumm et al.
6,138,711 A 10/2000 Lung-Po
6,148,461 A 11/2000 Cook et al.
6,206,654 B1 3/2001 Cassidy
6,237,621 B1 5/2001 Chaffee
6,237,653 B1 5/2001 Chaffee
6,240,584 B1 6/2001 Perez et al.
D446,284 S 8/2001 Chaffee
6,287,095 B1 9/2001 Saputo et al.
6,296,459 B1 10/2001 Saputo et al.
6,332,760 B1 12/2001 Chung
6,378,152 B1 4/2002 Washburn et al.
6,460,209 B1 10/2002 Reeder et al.
6,483,264 B1 11/2002 Shafer et al.
6,508,264 B2 1/2003 Chaffee
6,530,751 B1 3/2003 Song et al.
6,565,315 B1 5/2003 Bertels et al.
6,643,875 B2 11/2003 Boso et al.
6,651,283 B1 11/2003 Cook et al.
6,659,737 B2 12/2003 Bader et al.
6,701,559 B2 3/2004 Boso et al.
7,039,972 B2 5/2006 Chaffee
7,040,347 B2 5/2006 Wang
7,128,525 B2 * 10/2006 Tsai ..... 415/128
7,152,265 B2 12/2006 Chung
7,198,076 B2 * 4/2007 Wu ..... 141/197
7,225,488 B2 * 6/2007 Wu ..... 5/713
7,246,394 B2 7/2007 Wang
7,284,968 B2 * 10/2007 Tsai ..... 417/423.14
2001/0044969 A1 11/2001 Chaffee
2002/0124320 A1 9/2002 Washburn et al.
2002/0138909 A1 10/2002 Boyd
2002/0138910 A1 10/2002 Boyd
2002/0178503 A1 12/2002 Reeder et al.
2002/0194678 A1 12/2002 Chung
2003/0003001 A1 1/2003 Chaffee
2003/0024050 A1 2/2003 Boso et al.
2003/0188388 A1 10/2003 Boso et al.
2003/0192123 A1 10/2003 Chaffee
2003/0192127 A1 10/2003 Cook et al.
2004/0074004 A1 4/2004 Boso et al.
2004/0107503 A1 6/2004 Tu
2004/0117912 A1 6/2004 Cheng
2004/0123394 A1 7/2004 Wang
2004/0123395 A1 7/2004 Wang
2004/0123396 A1 7/2004 Wang
2004/0244116 A1 12/2004 Chun
2004/0261183 A1 * 12/2004 Tsai ..... 5/713
2006/0143831 A1 7/2006 Wu

FOREIGN PATENT DOCUMENTS

WO WO 03/093709 A1 5/2003
WO WO 03/093709 A1 11/2003
WO WO 2004/045343 A1 6/2004
WO WO 2005/000074 A1 1/2005

* cited by examiner

REVERSIBLE INFLATION SYSTEM

BACKGROUND

This invention relates generally to air pumps and more specifically to air pumps that can both inflate and deflate inflatable objects.

Traditional furniture requires a large amount of space. Quite often, an individual does not have sufficient space to store furniture that he or she would use only on occasion. Similarly, traditional furniture is not easily portable, further limiting its ability to fill temporary furniture requirements. For example, it is often infeasible for a person with little storage space to stow a traditional bed in anticipation of overnight guests. Similarly, it is impractical for a person to transport a traditional bed to accommodate an overnight trip. As a result, a need exists for compact and portable furniture.

To fill this need, various types of inflatable furniture have been designed. One example of inflatable furniture is an air mattress. However, users of inflatable mattresses have experienced several shortcomings.

In a typical piece of inflatable furniture, a pump is often used to inflate the furniture. To deflate the mattress, a release valve is typically present. To deflate the mattress, the release valve is opened, and air escapes from the mattress through the release valve. Often, the only force assisting in the deflation is the force created by gravity on the top of the furniture. Deflation using only this force is time-consuming, and often leaves a significant amount of air within the inflatable furniture. An impatient user often resorts to applying additional force to the piece of furniture by walking on the deflating furniture or folding the furniture prior to it being completely deflated. These actions can damage the furniture, or otherwise compromise the air-tight quality of the furniture. Furthermore, air remaining in the furniture also increases its storage size. Therefore, a compact yet efficient system to quickly and completely inflate and deflate inflatable furniture is desired.

Inflatable furniture must be easily inflated and deflated. To aid in storage and transportation, the furniture must also be light weight, yet durable. Furthermore, the furniture must be able to collapse to a size that is compatible with storage and transportation. Therefore, it is an objective of this invention to provide an efficient and compact reversible inflation system that conveniently and quickly inflates and deflates a piece of inflatable furniture.

BRIEF SUMMARY

A reversible inflation system is disclosed for filling air bladders for air mattresses, other furniture, pools, sporting goods, or other items. In a preferred embodiment, the inflation system is reversible, allowing a single pump to be used both for inflation and deflation of the air bladder. This embodiment of the inflation system includes a housing, a motor located within said housing, an impeller operatively attached to said motor within said housing, a valve traversing a first wall of said housing, and a slide located adjacent to an orifice in said housing; said slide having a first and a second position, wherein in said first position, said impeller moves air from said orifice to said valve, and in said second position, said impeller moves air from said valve to said orifice.

In another embodiment, a reversible pumping mechanism includes a pump housing, a motor chamber within said pump housing, an impeller chamber within said pump housing, a wall separating said motor chamber from said impeller chamber, a motor located in said housing, an impeller within said impeller housing operatively connected to said motor, and a slide having a first position and a second position, wherein said slide directs air into said impeller chamber in said first position, and said slide directs air from said impeller chamber opening in said second position.

In a third embodiment, a piece of inflatable furniture includes a bladder, a reversible inflation system recessed in said bladder, an inflation system housing, a pump located with said inflation system housing, said pump housing having a pump inlet and a pump outlet, a slide adjacent to said pump having a first position and a second position, wherein said slide is in fluid communication with said pump inlet in said first position, and said slide is in fluid communication with said pump outlet in said second position.

DETAILED DESCRIPTION OF THE DRAWINGS AND THE PRESENTLY PREFERRED EMBODIMENTS

Figure 1:
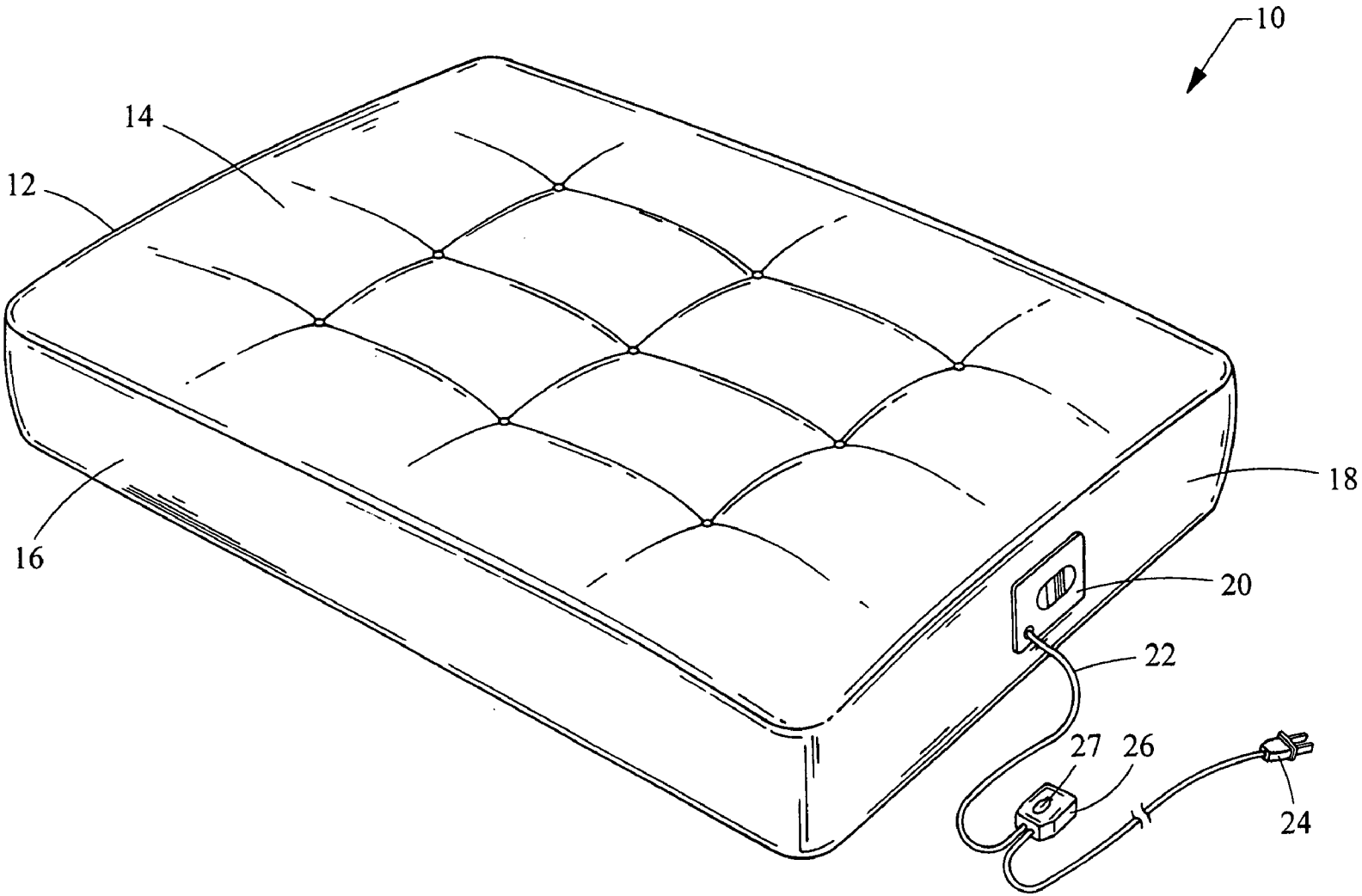
FIG. 1 is an example of an inflatable object employing a reversible inflation system of the present invention.

FIG. 1 illustrates a piece of inflatable furniture 10. In the present embodiment, the inflatable furniture 10 includes an inflatable object 12. Presently, the inflatable object 12 is a mattress. The current embodiment of the inflatable object 12 has a top wall 14, a bottom wall (not shown), two side walls 16 (one shown), and two end walls 18 (one shown). The apparatus 10 has a reversible inflation system 20, preferably located within an end wall 18 of the inflatable object 12.

A power cord 22 is operatively connected to the reversible inflation system 20. At the free end of the power cord 22, a plug 24 is present. The plug 24 is designed to operatively connect to an electrical outlet, as known in the art. When connected to an outlet, the plug 24 and power cord 22 supply electricity to the reversible inflation system 20. In an alternate embodiment, batteries supply power to the reversible inflation system 20. For example, a battery pack, located either externally or recessed within the inflatable object 12, can be electrically connected to the reversible inflation system 20.

In the present embodiment, a control device 26 is located on the power cord 16. Presently, the control device 26 contains a power switch 27 which activates the reversible inflation system 20. The power switch 27 may be any of the many well-known mechanisms for selectively connecting two conductors to supply electricity to a point of use. Preferably, the power switch 27 allows the reversible inflation system 20 to be energized such that it either inflates or deflates the inflatable object 12. In an alternate embodiment, the control device 26 may also contain an adjustment device (not shown). The adjustment device allows for air to be bled from the inflatable object 12. In other embodiments, the control device 26 can be operatively connected to the reversible inflation system 20 by a separate cord, or alternatively, can be wirelessly connected to the reversible inflation system 20.

As described hereinafter, the reversible inflation system 20 can be used to inflate the inflatable object 12. Conversely, as discussed hereinafter, the inflation system 20 can also be reversed to draw air out of the inflatable object 12, so that the inflatable object 12 can be rapidly deflated for storage or transport.

Figure 2A:
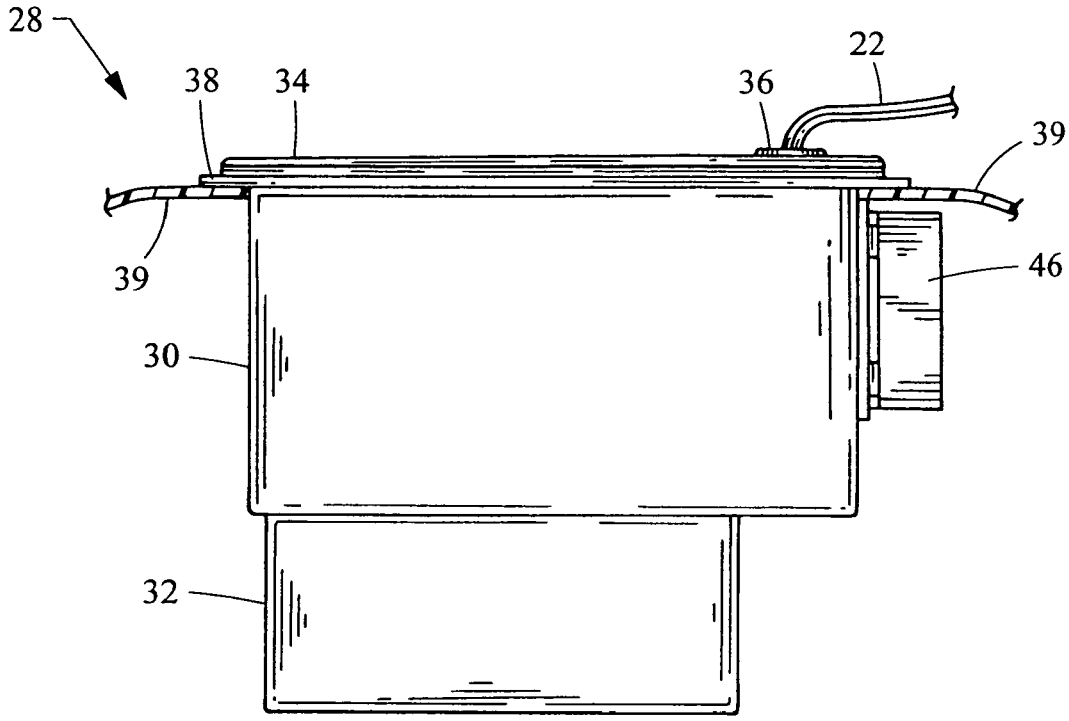
FIG. 2A is a side view of the reversible inflation system of FIG. 1.
Figure 2B:
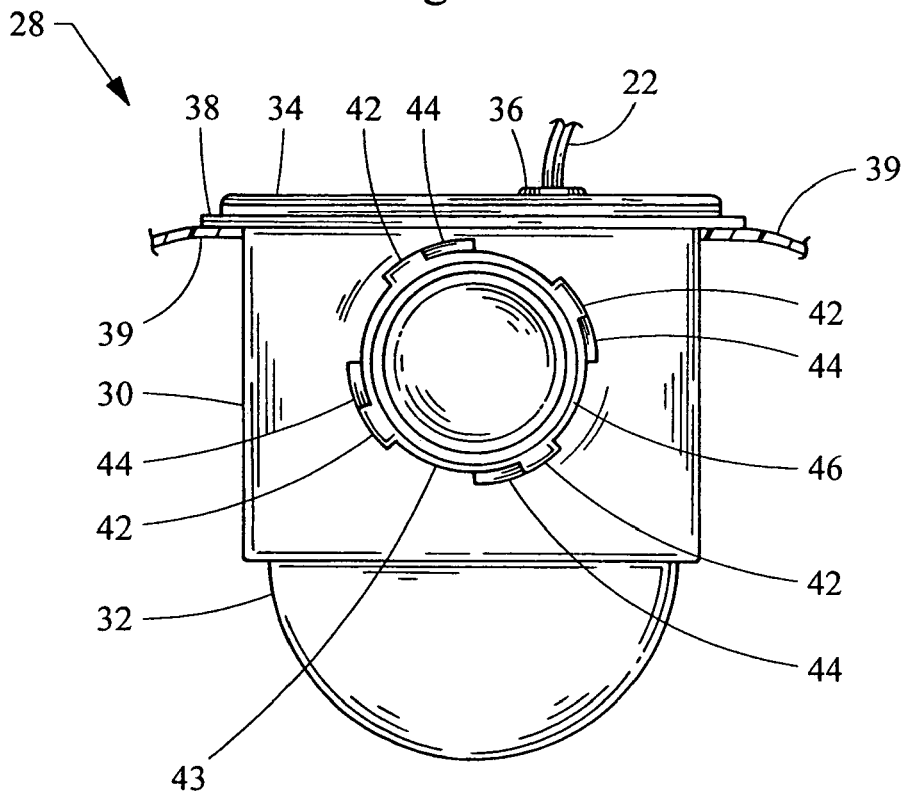
FIG. 2B is an end view of the reversible inflation system of FIG. 1.
Figure 2C:
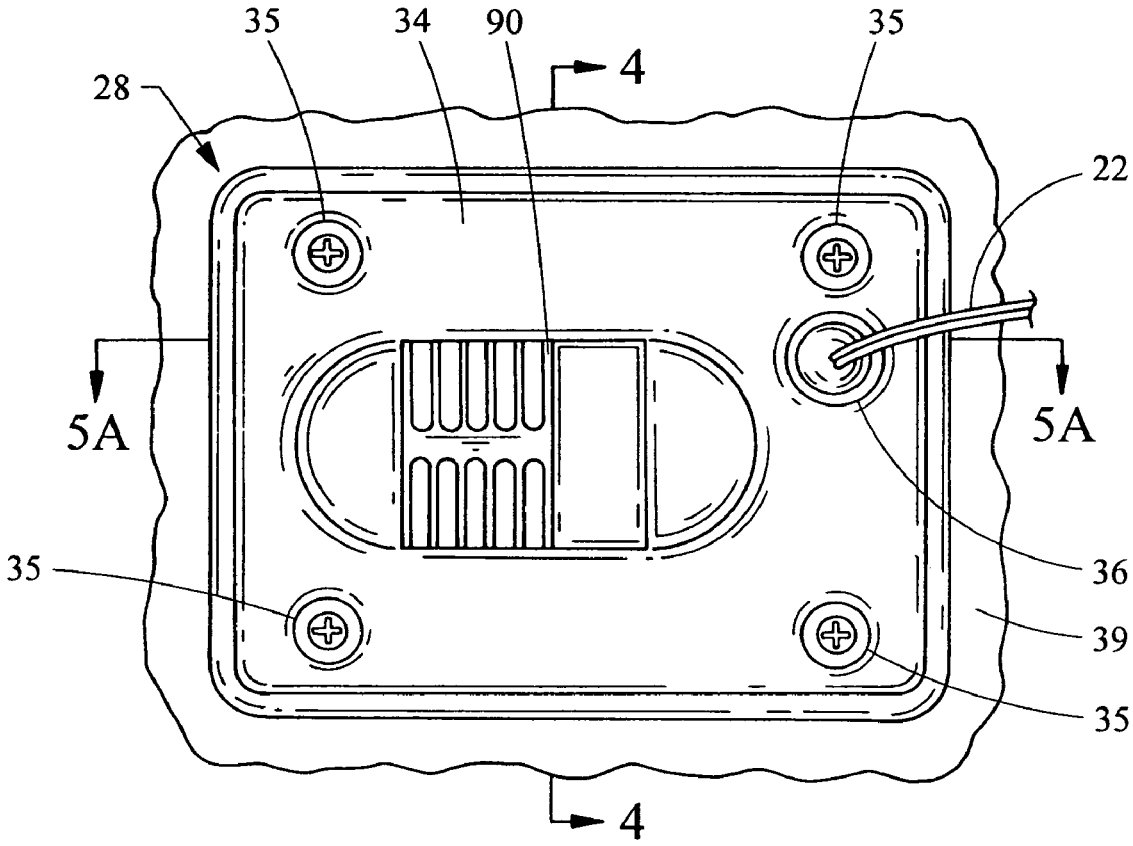
FIG. 2C is a top view of the reversible inflation system of FIG. 1.

FIGS. 2A-C illustrate an embodiment of a housing 28 of the reversible inflation system 20. The housing 28 has an upper portion 30 and a lower portion 32. A flange 38 is located on the upper portion 30. The flange 38 encloses the periphery of the upper portion 30. The flange 38 is designed to attach to a bladder 39 of the inflatable object 12. The flange 38 must be attached to the bladder 39 in such a manner as to create an airtight seal. Presently, the flange 38 is attached to the bladder 39 by an adhesive. However, in alternate embodiments, the flange 39 can be attached to the bladder 39 by clips, stitching or other airtight methods.

In the present embodiment, the lower portion 32 has a round, semi-circular profile, as demonstrated in FIG. 2B. However, in alternate embodiments, the profile of the lower portion 32 can be square or rectangular. Presently, the upper portion 30 of the housing 28 extends horizontally beyond the lower portion 32 of the housing 28.

As shown in FIG. 2C, the housing 28 includes a lid 34. The lid 34 is attached to the housing 28 by four screws 35 located at the corners of the lid 34. The lid 34 has an aperture 37 located near the center. The power cord 22 traverses the lid 34. A seal 36 physically connects the power cord 22 to the lid 34. The seal 36 minimizes air flow where the power cord 22 traverses the lid 34.

A diaphragm valve 46 is located at one end of the upper portion 30. The diaphragm valve 46 has four valve flanges 42. The four valve flanges 42 are located equidistantly around the circumference of the diaphragm valve 46. The diaphragm valve 46 is installed through a valve aperture 43 located in the upper portion 30. The valve aperture 43 is shaped to correspond to the diaphragm valve 46. The shape of the valve aperture 43 also has openings 44 corresponding to the valve flanges 42. To insert the diaphragm valve 46 into the upper portion 30, the valve flanges 42 are aligned so that the valve flanges 42 can traverse the openings 44. When the valve flanges 42 have traversed the openings 44, the diaphragm valve 46 is rotated. In the present embodiment, the cross section of the valve flanges 42 is wedge-shaped. When the diaphragm valve 46 is rotated, an increased amount of the surface area of the valve flanges 42 contact the upper portion 30, and the diaphragm valve 46 locks into position. Alternatively, the diaphragm valve 46 can be attached to the upper portion 30 by adhesives, screw, nuts, or other attaching means.

Figure 3:
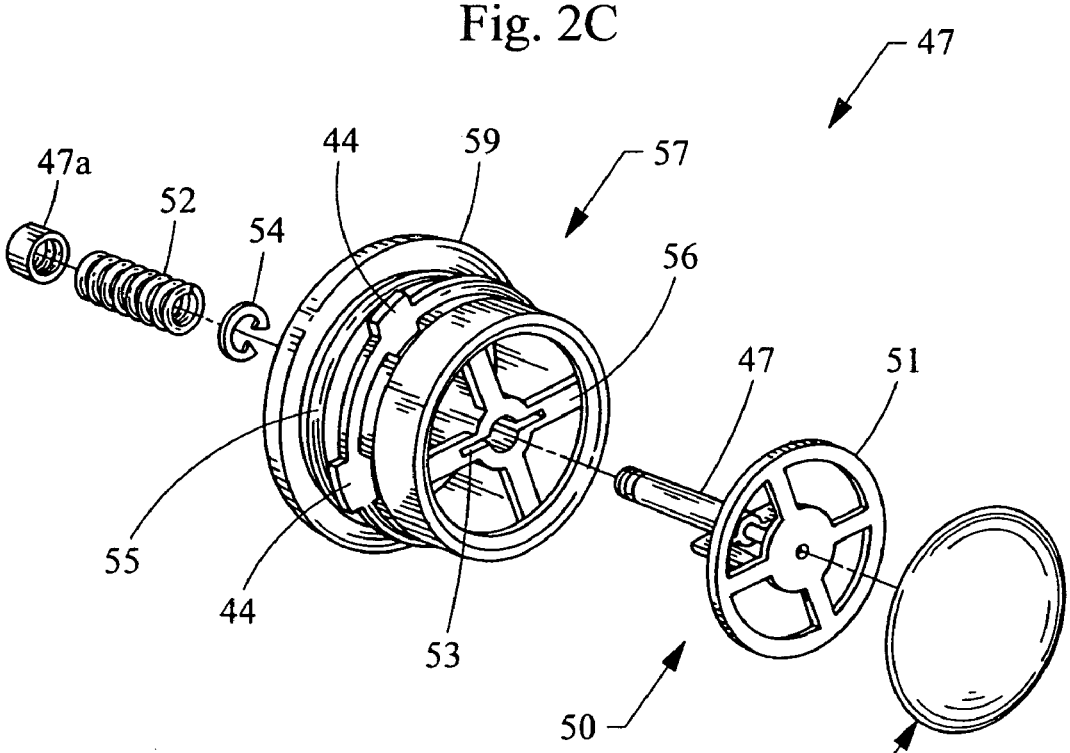
FIG. 3 is an exploded view of a diaphragm valve.

As shown in FIG. 3, the diaphragm valve 46 contains a diaphragm 48. The diaphragm 48 is adjacent to a diaphragm stem 50. The diaphragm valve 46 further contains a spring 52, a lock nut 54, and a valve housing 57.

The valve housing 57 is generally a cylindrically-shaped. The valve housing 57 contains the valve seat 56 at a first end and a flange 59 on the second end. An o-ring 55 is preferably located between valve flanges 44 and the flange 59.

The diaphragm stem 50 has a rigid circular webbing 51 at one end. The webbing 51 prevents the diaphragm 48 from bending into the valve housing 46, allowing air flow. A stem rod 47 is perpendicularly attached to the rigid circular webbing 51.

The diaphragm 48 is preferably round, which has approximately the diameter of the valve housing 57. In the preferred embodiment, the diaphragm 48 is made of flexible material, such as rubber.

As assembled, the stem rod 47 is located within an aperture 53 on the valve seat 56. The spring 52 is located on the stem rod 47 between the valve seat 56 and the lock nut 54, which is located at the free end of the stem rod 47. The spring 52 is positioned to bias the diaphragm stem 50 against the valve seat 56. When the diaphragm 48 and diaphragm stem 50 are positioned against the valve seat 56, the diaphragm 48 allows air to exit the housing 28 through the diaphragm valve 46. However, the diaphragm 48 and diaphragm stem 59 prevents any air from entering the housing 28 through the diaphragm valve 46.

Figure 4:
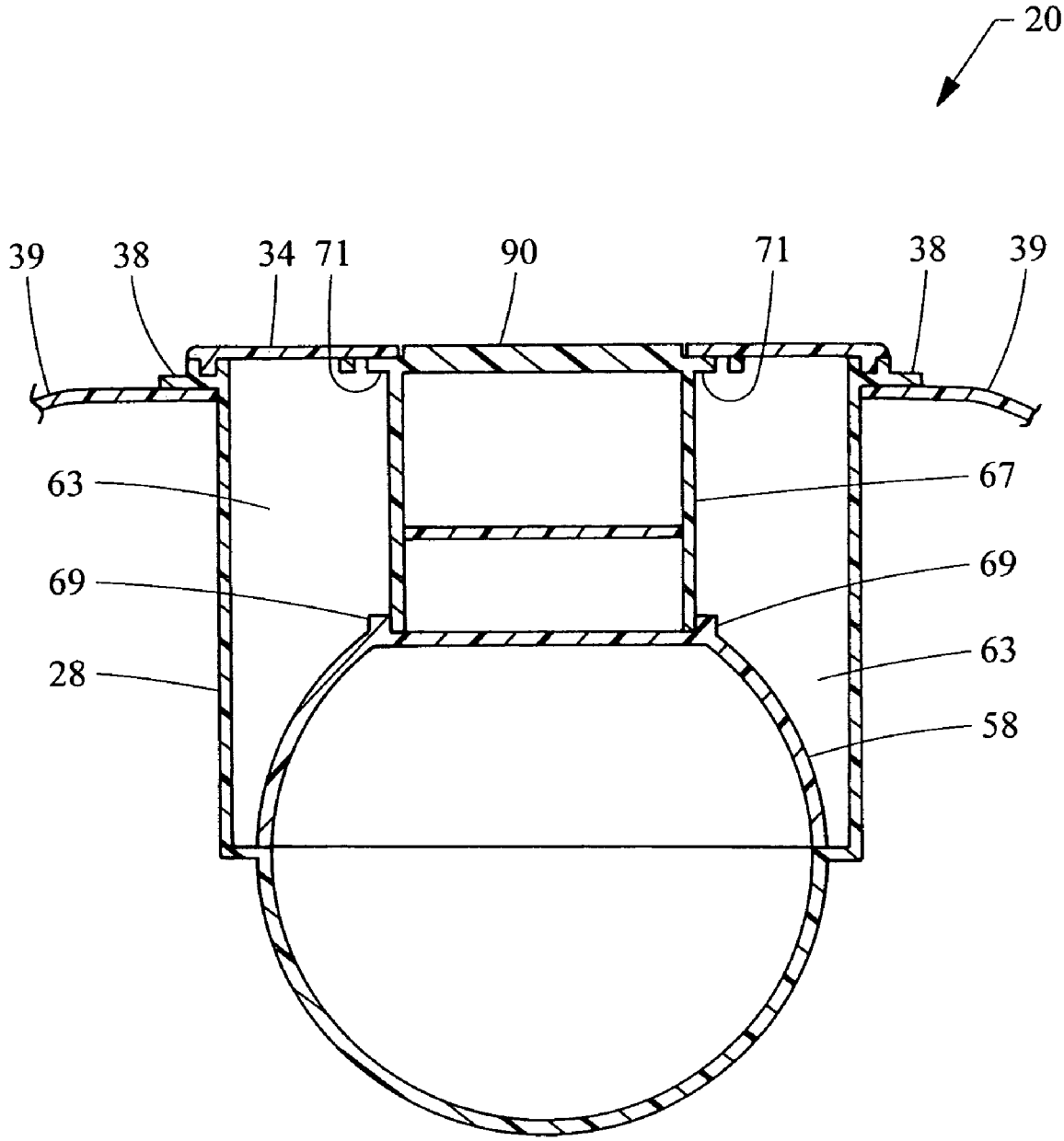
FIG. 4 is a end, cross-sectional view of the reversible inflation system.
Figure 5A:
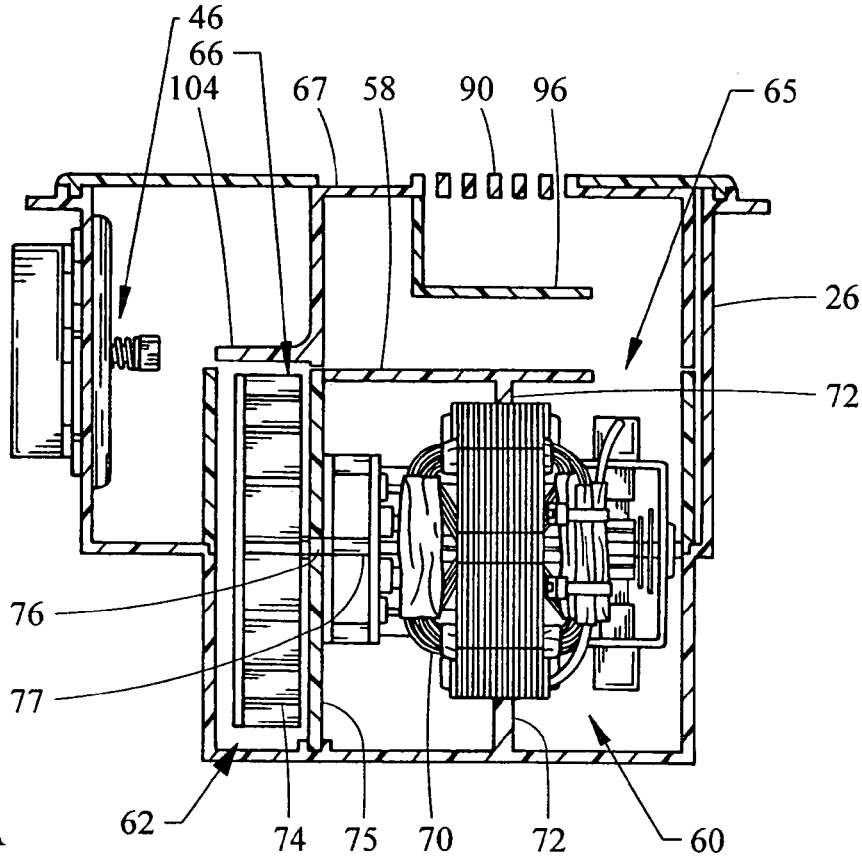
FIG. 5A is a side, cross-sectional view of the reversible inflation system of FIG. 1.
Figure 5B:
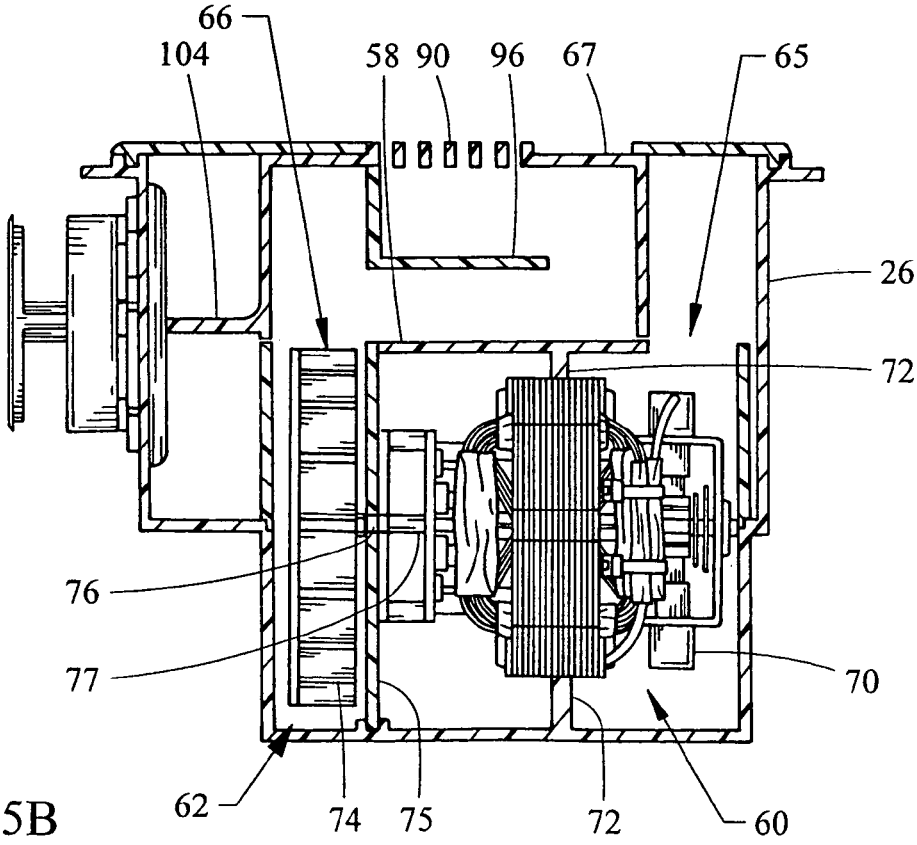
FIG. 5B is another side, cross-sectional view of the reversible inflation system of FIG. 1.

FIGS. 4-5B demonstrate the internal structure of the housing 28 of the reversible inflation system 20. Within the housing 28, a chamber cover 58 separates a motor chamber 60 and an impeller chamber 62 from the remainder of the contents of the housing 28. Above the chamber cover, the chamber cover 58 and interior of the housing 28 form air channels 63. Preferably, the chamber cover 58 contains two openings—the motor chamber opening 65 and the impeller chamber opening 66. A slide 67 is located adjacently above the chamber cover 58 and is held into position by slide rails 69 and the housing lid 34. A vent 90 in the slide 67 fits into the aperture of the lid. The slide 67 contains flanges 71 that extend underneath the lid 34.

Within the motor chamber 60 is a motor 70. The motor 70 is held in position within the motor chamber 60 by two motor stands 72. The impeller chamber 62 contains an impeller 74. Between the motor chamber 60 and the impeller chamber 62 is a separating wall 75. The motor chamber 60 is in communication with the impeller chamber 62 via a chamber aperture 76, which is located within the separating wall 75. A drive shaft 77 operatively connects the motor 70 to the impeller 74 through the chamber aperture 76. When the motor 70 is energized, the motor 70 rotates the drive shaft 77, which thereby rotates the impeller 74.

The slide 67 determines whether the pump will inflate or deflate the inflatable object 12. The motor chamber 60, motor 70, impeller chamber 62, and impeller 74 function as a unidirectional pump. In this pump, the motor chamber opening 65 serves as a pump inlet port, and the impeller chamber opening 66 serves as a pump outlet port. Fluid is drawn into the pump through the pump inlet port, through the motor chamber 60 and impeller chamber 62, and expelled through the pump outlet port.

Figure 6A:
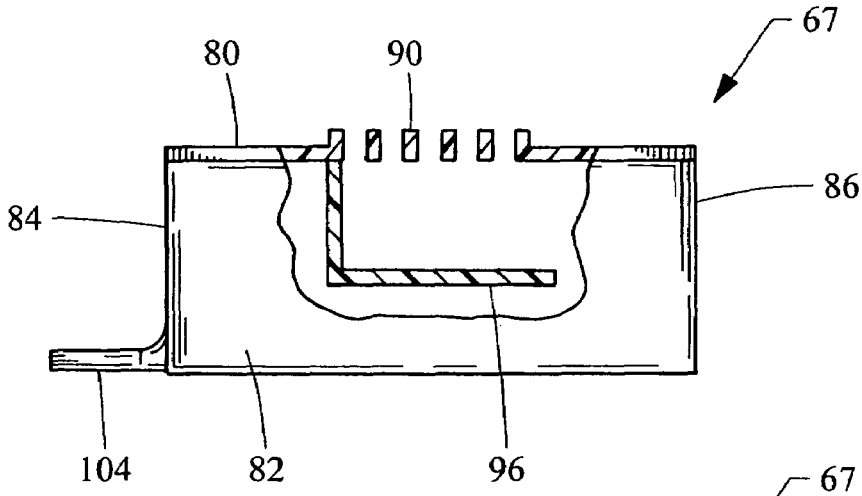
FIG. 6A is a side, partial cross-sectional view of a slide.
Figure 6B:
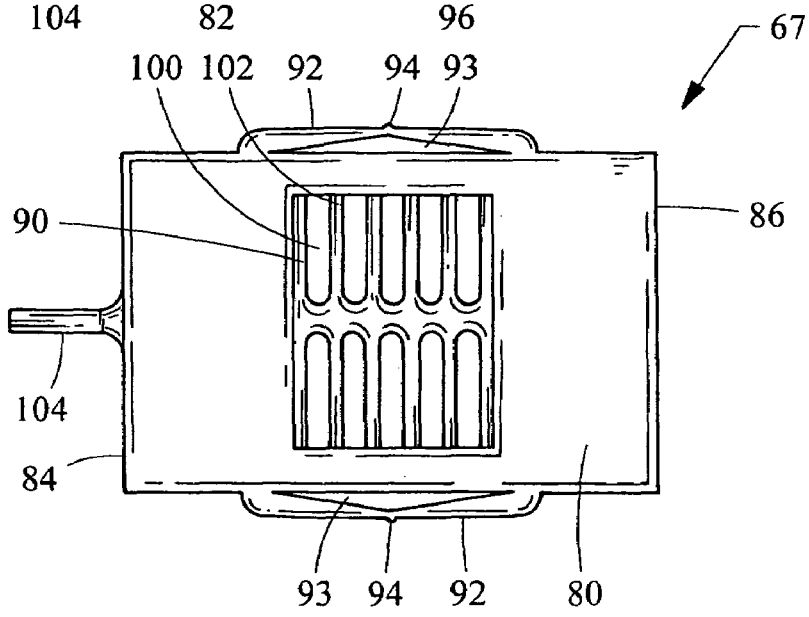
FIG. 6B is a top view of the slide.
Figure 6C:
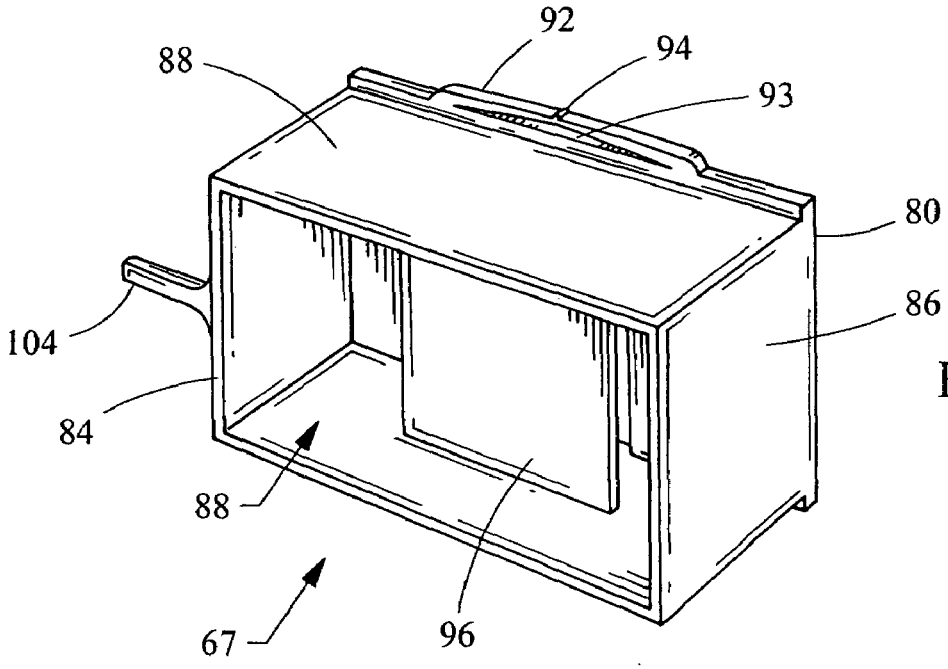
FIG. 6C is a bottom, perspective of the slide.

FIGS. 6 A-C illustrates an embodiment of the slide 67. The slide 67 contains a top wall 80, two side walls 82, a front wall 84, and a back wall 86. The bottom 88 of the slide 67 is open. In the present embodiment, the vent 90 is located on the top wall 80. The vent 90 is preferably a grille consisting of apertures 100 located in between grating 102.

Adjacent to the top wall 80 above the side walls 82 are ribs 92. Openings 93 exist between the ribs 92 and the top wall 80. Each rib 92 has a nub 94. The function of the ribs 92 and nubs 94 will be discussed further hereinafter.

Preferably, a baffle 96 is located within the slide 67. The baffle 96 is an L-shaped ledge located beneath the vent 90. In the presently preferred embodiment, the baffle 96 directs air between the vent 90 and the interior of the slide 67 near the back wall 86.

A plunger 104 is preferably located on the exterior of the front wall 84. In the present embodiment, the plunger 104 is centered at the bottom of the front wall 84.

FIGS. 5A and 5B demonstrate the two positions between which the slide 67 is movable. As shown in FIG. 5A, the slide 67 is situated in a position for inflation. In this position, a portion of the bottom 88 of the slide 67 is in fluid communication with the motor chamber 60 via the motor chamber opening 65. The remainder of the bottom 88 is abutted against the chamber cover 58. As a result, the vent 90 is in fluid communication with the motor chamber 60. The plunger 104 is not in contact with the diaphragm stem 50.

In this position, the impeller chamber 62 is in fluid communication with the air channels 63 via the impeller chamber opening 66. In the inflation position, the diaphragm 48 and diaphragm stem 50 are against the valve seat 56. The diaphragm 48 and diaphragm stem 50 prevent air from entering the air channels 63 from the interior of the inflatable object 12. However, in this position, the flexible diaphragm 48 and diaphragm stem 50 allow air to enter the interior of the inflatable object 12 from the air channels 63.

In the second position, as shown in FIG. 5B, the slide 67 is in the deflation position. In this position, a portion of the bottom 88 of the slide 67 is in fluid communication with the impeller chamber opening 66. The remainder of the bottom 88 is abutted against the chamber cover 58. As a result, the impeller chamber 62 is in fluid communication with the vent 90. The motor chamber 60 is in fluid communication with the air channels 64 via the motor chamber opening 65.

In this position, the plunger 104 is pressed against and displaces the diaphragm stem 50. When the diaphragm stem 50 is displaced, the spring 52 is compressed, and, the diaphragm 48 and rigid circular webbing 51 are no longer seated against the valve seat 56; thereby allowing the interior of the inflatable 12 object to be in communication with the air channels 63.

Figure 7A:
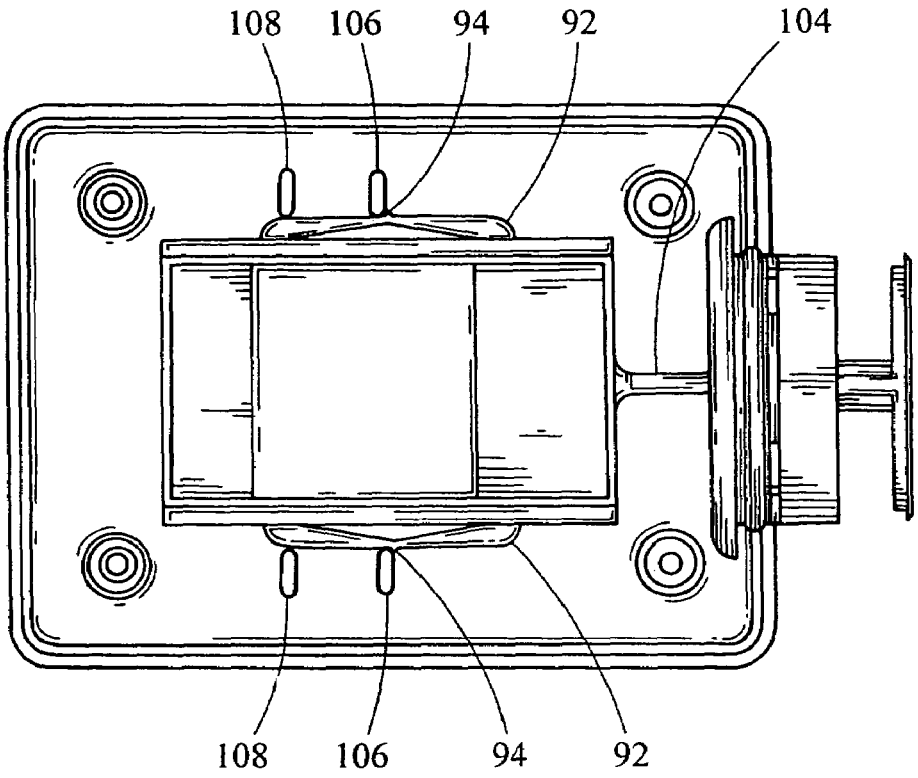
FIG. 7A is a bottom view of the housing lid with the side in the inflation position.
Figure 7B:
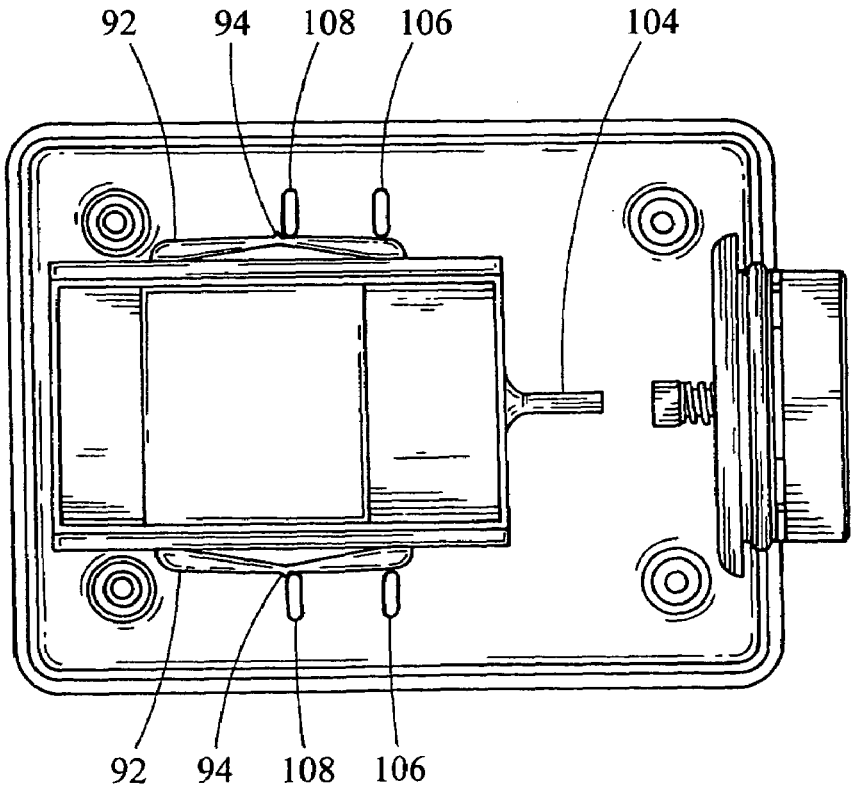
FIG. 7B is a bottom view of the housing lid with the side in the deflation position.

FIGS. 7A-B illustrates how the slide 67 locks into the inflation and deflation positions. Four tabs are located on the underside of the lid. A first pair of tabs 106 is located to lock the slide 67 in the inflation position. A second pair of tabs 108 is located to lock the slide 67 in the deflation position.

In the inflation position, as illustrated in FIG. 7A, the nubs 94 on the ribs 92 are positioned on the outer side of the first pair of tabs 106. In this position, the ribs 92 are in a relaxed position against the first set of tabs 106 and holds the nubs 94 against the tabs 106.

FIG. 7B demonstrates the deflation position. In the deflation position, the nubs 94 on the ribs 92 are positioned preferably on the outer side of the second pair of tabs 108. The ribs 92 are in a relaxed position against the second set of tabs 108 and holds the nubs 94 against the tabs 108. The ribs 92 are flexible, and are capable of compressing toward the top wall 80 of the slide 67 In this position, the nubs 94 are displaced, and the slide 67 is capable of moving between the inflation position and the deflation position.

In operation, the same motor 70 and impeller 74 are used to both inflate and deflate the inflatable object 12. To that extent, the motor 70 and the impeller 74 move air in only one direction. More specifically, the motor 70 and impeller 74 pull air in through the motor chamber opening 65, moves the air through the motor chamber 60 and impeller chamber 62, and pushes the air out of the impeller chamber opening 66.

The position of the slide 67 determines whether the pump inflates or deflates the inflatable object 12. As shown in FIG. 5A, when the slide 67 is in the inflation position, the motor 70 and impeller 74 draw air in from the atmosphere through the vent 90. The baffle 96 then directs the air toward the back wall 86 of the slide 67. The air is then drawn into the motor chamber opening 65 and travels through the motor chamber 60 and impeller chamber 62. The impeller 74 then pushes the air out of the impeller chamber opening 66. The air fills the air channel 63 and the pressure in the air channel 63 forces air past the diaphragm 48 into the interior of the inflatable object 12. In this manner, the inflatable object 12 in inflated.

When the slide 67 is moved to the deflation position, as shown in FIG. 5B, the plunger 104 forces the diaphragm stem 50 and diaphragm 48 away from the valve seat 56, thereby allowing fluid communication between the interior of the inflatable object 12 and the air channel 63. When the diaphragm stem 50 and diaphragm 48 is away from the valve seat, the force created by gravity pushed air out of the inflatable object 12 through the diaphragm valve 46. The motor 70 and impeller 74 assists in the deflation by pulling air from the interior of the inflatable object 12 through the open diaphragm valve 46, and into the air chamber 63. The motor 70 and impeller 74 draw the air in the air channel 63 through the motor chamber opening 65, and through the motor chamber 60 and impeller chamber 62. The motor 70 and impeller 74 then pushes the air through the impeller chamber 62 opening, past the baffle 96 in the slide 67, and out the vent 90.

It is therefore intended that the foregoing detailed description be regarded as illustrative rather than limiting, and that it be understood that it is the following claims, including all equivalents, that are intended to define the spirit and scope of this invention.

The invention claimed is:

1. A reversible inflation system for a bladder comprising:

a housing;

a motor located within said housing;

a unidirectional impeller operatively attached to said motor within said housing;

a valve traversing a first wall of said housing; and a slide located adjacent to an orifice in said housing; said slide having a first and a second position, wherein in said first position, said impeller moves air from said orifice to said valve, and in said second position, said impeller moves air from said valve to said orifice;

a motor chamber for containing said motor;

a first opening located in said motor chamber;

a unidirectional impeller chamber for containing said impeller;

an second opening located in said impeller chamber;

a third opening operatively connecting said motor chamber and said impeller chamber;

at least one air channel located within said housing and operatively connected to said valve; and a fourth opening operatively connected to an interior of said slide.

2. Said reversible inflation system for a bladder of claim 1 further comprising a power source operatively connected to said motor, wherein said power source provides power to said motor, and said motor rotates said impeller.

3. Said reversible inflation system for a bladder of claim 2 further comprising a control switch in communication with said motor.

4. Said reversible inflation system for a bladder of claim 1 wherein said slide operatively connects said fourth opening and said first opening in said first position, and said slide operatively connects said second opening and said fourth opening in said second position.

5. Said reversible inflation system for a bladder of claim 4 wherein said impeller moves air from said fourth opening through said first opening, said third opening, said second opening and out said valve when said slide is in said first position; and said impeller moves air from said valve through said second opening, said third opening, said first opening, and out said fourth opening when said slide is in said second position.

6. A reversible inflation system for a bladder comprising:

a housing;

a motor located within said housing;

a unidirectional impeller operatively attached to said motor within said housing;

a valve traversing a first wall of said housing;

a slide located adjacent to an orifice in said housing; said slide having a first and a second position, wherein in said first position, said impeller moves air from said orifice to said valve, and in said second position, said impeller moves air from said valve to said orifice; and a plunger operatively connected to said slide.

7. Said reversible inflation system for a bladder of claim 6 wherein said plunger opens said valve.

8. The pump mechanism of claim 6 further comprising a vent located on said slide, wherein said vent is in fluid communication with the atmosphere.

9. A reversible pumping mechanism comprising:

a pump housing;

a motor chamber within said pump housing;

an impeller chamber within said pump housing;

a wall separating said motor chamber from said impeller chamber;

a motor located in said motor housing;

a unidirectional impeller within said impeller housing operatively connected to said motor;

a slide having a first position and a second position, wherein said slide directs air into said impeller chamber in said first position, and said slide directs air from said impeller chamber in said second position; and a baffle within said slide.

10. The pump mechanism of claim 9 further comprising a diaphragm valve traversing said pump housing.

11. The pump mechanism of claim 10 further comprising a plunger situated on said slide, wherein said plunger opens said diaphragm valve when said slide is in said second position.

* * * * *